US011466888B2

(12) United States Patent
Jang

(10) Patent No.: US 11,466,888 B2
(45) **Date of Patent: *Oct. 11, 2022**

(54) SYSTEM AND METHOD FOR CONTROLLING AIR CONDITIONER

(71) Applicants: Hyundai Motor Company, Seoul (KR); Kia Motors Corporation, Seoul (KR)

(72) Inventor: Kyung Mo Jang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 469 days.

This patent is subject to a terminal disclaimer.

(21) Appl. No.: 16/655,692

(22) Filed: Oct. 17, 2019

(65) Prior Publication Data

US 2020/0348039 A1 Nov. 5, 2020

(30) Foreign Application Priority Data

May 2, 2019 (KR) ..... 10-2019-0051383

(51) Int. Cl.

| | |
|---|---|
| ***F24F 11/64*** | (2018.01) |
| ***F24F 11/61*** | (2018.01) |
| ***B05B 13/04*** | (2006.01) |
| ***F24F 11/72*** | (2018.01) |
| *F24F 110/22* | (2018.01) |
| *F24F 110/12* | (2018.01) |

(52) U.S. Cl.

CPC ..... *F24F 11/64* (2018.01); *B05B 13/0452* (2013.01); *F24F 11/61* (2018.01); *F24F 11/72* (2018.01); *F24F 2110/12* (2018.01); *F24F 2110/22* (2018.01)

(58) Field of Classification Search

CPC .... F24F 11/64; F24F 2110/12; F24F 2110/22; F24F 11/65; B05B 13/0452

See application file for complete search history.

(56) References Cited

U.S. PATENT DOCUMENTS 10,627,125 B2 * 4/2020 Jang ..... F24F 11/30
11,148,163 B2 * 10/2021 Jang ..... G05B 19/0421

(Continued)

*Primary Examiner* — Mohammad Ali
*Assistant Examiner* — Vincent W Chang
(74) *Attorney, Agent, or Firm* — Morgan, Lewis & Bockius LLP

(57) ABSTRACT

A system includes an air conditioner in each zone of a painting process line supplying heated air according to temperature/humidity stabilization conditions for a painting process of each zone of a spray booth; a controller transmitting operation information related to the air conditioner including temperatures and humidities of outdoor air flowing into the air conditioner and indoor air inside each zone of the booth and operating the air conditioner when a control value is received; and a server learning operation information history of the air conditioner collected through the air conditioning controller to accumulate the learned data in a database and extracting the control value for each of controllers of the air conditioner according to an initial operation condition of the air conditioner from the learned data in the database to control each of the controllers of the air conditioner for a predetermined time period based on the extracted data.

17 Claims, 10 Drawing Sheets

(56) References Cited

U.S. PATENT DOCUMENTS

| | | | | |
|---|---|---|---|---|
| 2009/0210094 | A1* | 8/2009 | Boder | G05D 27/02 700/276 |
| 2013/0171920 | A1* | 7/2013 | Bhattacharya | B05B 12/08 454/52 |
| 2015/0352585 | A1* | 12/2015 | Larson | B05B 16/60 118/712 |
| 2019/0271483 | A1* | 9/2019 | Joo | F24F 11/62 |
| 2020/0078809 | A1* | 3/2020 | Hirano | B05B 13/0452 |
| 2021/0041121 | A1* | 2/2021 | Park | G06N 20/10 |
| 2021/0254851 | A1* | 8/2021 | Taguchi | F24F 11/48 |

* cited by examiner

<Temperature control>

<Humidity control>

<Temperature control>

<Humidity control>

SYSTEM AND METHOD FOR CONTROLLING AIR CONDITIONER

CROSS-REFERENCE TO RELATED APPLICATION

The present application claims priority to Korean Patent Application No. 10-2019-0051383 filed on May 2, 2019, the entire contents of which is incorporated herein for all purposes by this reference.

BACKGROUND OF THE INVENTION

Field of the Invention

The present invention relates to an air conditioner control system and method, and more particularly, to a system and a method for controlling an air conditioner that shorten an initial operation stabilization time of the air conditioner mounted in a painting process line for a vehicle.

Description of Related Art

Generally, an air conditioner mounted in a painting process line for a vehicle maintains an indoor space of a spray booth in a condition in which temperature and humidity are stabilized at a constant value to form a film of paint on the vehicle or the vehicle body.

A conventional air conditioner is manually operated by an operator and the indoor space of the spray booth is very large. Thus, the air conditioner is operated in advance before the vehicle is put to maintain the temperature and humidity in the stabilization condition.

FIG. 1A and FIG. 1B are graphs showing an energy loss problem caused by a conventional air conditioner operation control.

Referring to FIG. 1A and FIG. 1B, an initial operation and a stop of the conventional air conditioner depends on the operator's experience so that deviation in an initial operation time of the air conditioner is generated. This causes energy loss due to accumulation of the unnecessary air conditioner operation time.

A time to reach the stabilization conditions of the temperature and the humidity may be changed due to various reasons such as changes in temperature and humidity of outdoor air, the spray booth size, heating performance change due to aging of the air conditioner, and control condition adjustment of each control module of the air conditioner.

In more detail, as various control modules of the air conditioner controlling a burner, washer, reheater, and steamer of the air conditioner are operated simultaneously at a time of initial operation of the air conditioner, the time to reach the stabilization conditions of the temperature and the humidity according to the temperature and the humidity of the outdoor air, which is a time for adjusting an initial operation condition of the air conditioner, takes excessively long.

For the present reason, the operator operates the air conditioner with a margin before the vehicle arrives at the spray booth to maintain the temperature and humidity stabilization conditions of the spray booth.

A wait time for adjusting the temperature and the humidity of the spray booth to the temperature and humidity stabilization conditions takes 40-80 minutes depending on skill of the operator, and energy loss due to accumulation of the wait time occurs.

The information disclosed in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a system and a method for controlling an air conditioner configured for shortening a time for stabilizing temperature and humidity of a spray booth by learning an initial operation condition of the air conditioner mounted in a painting process line for a vehicle to perform initial control for the air conditioner according to the initial operation condition based the learned value.

An exemplary embodiment of the present invention may provide the system for controlling the air conditioner of the painting process line including an air conditioning equipment, a spray booth, and an exhaust equipment that include a plurality of zones of the painting process line, having: an outdoor air measuring device configured to measure temperature and humidity of outdoor air flowing into the air conditioner; an indoor air measuring device configured to measure temperature and humidity inside each of the zones of the spray booth; the air conditioner disposed in each of the zones of the air conditioning equipment and configured to supply heated air according to temperature and humidity stabilization conditions required for a painting process of each of the zones of the spray booth; an air conditioning controller connected to the air controller and configured to transmit operation information related to the air conditioner including temperatures and humidities measured by the outdoor air measuring device and the indoor air measuring device and to operate the air conditioner when a control value is received; and a server connected to the plurality of air conditioning controllers and configured to learn operation information history of the air conditioner collected through the air conditioning controller to accumulate the learned data in a database and to extract the control value for each of controllers of the air conditioner according to an initial operation condition of the air conditioner from the learned data in the database to control each of the controllers of the air conditioner for a predetermined time period based on the extracted data.

The air conditioning controller may be configured to check whether temperature and humidity inside each of the zones of the spray booth reaches the temperature and humidity stabilization conditions and to measure a time taken to reach the temperature and humidity stabilization conditions from an initial operation time of the air conditioner to transmit the measured time to the server.

The temperature stabilization condition may have a predetermined allowable temperature based on the stabilization temperature and humidity stabilization condition may have a predetermined allowable humidity based on the stabilization humidity.

The server may include: a communicator connected to the air conditioning controller to collect the operation information related to the air conditioner; data manager configured to learn the control value for stabilizing the temperature and humidity inside the spray booth based on the operation information related to the air conditioner collected from the air conditioning controller disposed in each of the zones at an initial operation of the air conditioner to update the learned value in the database; an operation time predictor configured to derive a stabilization time required for temperature and humidity of each of the zones of the spray booth to reach values of the temperature and humidity stabilization conditions based on the temperature and the humidity of the outdoor air referring to the database and to determine an operation prediction time of the air conditioner by determining the stabilization time backward from a time when a vehicle arrives at each of the zones of the spray booth; the database configured to store the control value of each of the controllers of the air conditioner corresponding to the stabilization time according to the operation information history of the air conditioner in a learning table of the database; and a controller configured to interlock with the air conditioning controller disposed in each of the zones of the painting process line to control an operation time of the air conditioner when a production line of the vehicle is operated and the initial operation condition of the air conditioner.

The data manager may be configured to update the learning table of the database by matching the control value of each of control values of a burner controller, a washer controller, a reheater controller, a steam controller, and a supply fan controller of the air conditioner that generates the stabilization condition values with the stabilization time based on the temperature and the humidity of the outdoor air collected by the air conditioning controller at every initial operation time of the air conditioner for each of the zones.

The data manager may be configured to update currently learned information as latest information when information equal to the currently learned information exists in the learning table at a time of updating the learning table and to store currently learned information as new learning data in the learning table of the database when information equal to the currently learned information does not exist in the learning table.

The controller may be configured to search the operation information related to the air conditioner equal to current temperature and humidity of the outdoor air in the learning table of the database to detect the control value of each of the burner controller, the washer controller, the reheater controller, the steam controller, and the supply fan controller matched with the stabilization time for an initial operation control for the air conditioner when the air conditioner is operated.

The controller may be configured to detect a plurality of data of a first candidate data that are equal to the temperature and the humidity value of the outdoor air or have a minimum difference between the first candidate data and the temperature and the humidity of the outdoor air in the learning table of the database and to detect in the first candidate data a plurality of data of a second candidate data that are equal to the control value of each of the controllers of the air conditioner or have a minimum difference between the second candidate data and the control value of each of the controllers of the air conditioner to determine an average value of the detected plurality of data of the second candidate data corresponding to a control value of each of the controllers of the air conditioner reducing an initial operation time of each of the controllers of the air conditioner.

The controller may be configured to change a mode of the air conditioning controller to a manual mode to apply the detected control value to the initial operation condition of each of the controllers of the air conditioner for the predetermined time period and to switch a mode of the air conditioning controller to an automatic mode after the detected control value is applied to the initial operation condition of each of the controllers of the air conditioner.

The controller may be configured to forcibly apply the detected control value to the air conditioner for a predetermined time period equivalent to a predetermined percentage of the stabilization time after the mode of the air conditioning controller is changed to the manual mode.

The controller may be configured to monitor whether temperature and humidity inside the spray booth reaches the stabilization condition values and to learn the stabilization time and the control value of each of the controllers of the air conditioner corresponding to the stabilization time to update the learned values in the learning table of the database using the data manager when the temperature and humidity inside the spray booth reaches the stabilization condition values.

An exemplary embodiment of the present invention may provide the method for controlling the air conditioner by a server of a system for controlling the air conditioner which is disposed in each of zones of the painting process line including a spray booth, including: a) storing, by the server, operation time information related to the air conditioner collected from an air conditioning controller that is configured to control the air conditioner and is disposed in each of the zones of the painting process line in a temporary table of a database when operation of the air conditioner is started; b) detecting, by the server, a control value of each of controllers of the air conditioner that corresponds to temperature and humidity of outdoor air flowing into the air conditioner and is equal to the operation time information from the database in which operation information history of the air conditioner is stored; c) changing, by the server, a mode of the air conditioning controller to a manual mode and applying the control value of each of the controllers of the air conditioner to the air conditioning controller for a predetermined time period; and d) canceling, by the server, the control value applied to the air conditioning controller and switching the manual mode to an automatic mode of the air conditioning controller when a release time for the manual mode is reached after the predetermined time period.

The operation time information related to the air conditioner may include at least one among an operation time of the air conditioner, temperature and humidity measurement values of the outdoor air, temperature and humidity measurement values of indoor air which is air inside each of the zones of the spray booth to which the air conditioner supplies heated air for a painting process of each of the zones of the spray booth, temperature of the air conditioner, an opening rate of a washer pump of the air conditioner, and a target value, a measurement value, and a control value for initial operation of each of the controllers of the air conditioner.

The control value may include a control value for initial operation of each of the controllers of the air conditioner and an opening rate of a washer pump of the air conditioner.

Step b) may include: b-1) extracting, by the server, temperature and humidity measurement values of the outdoor air and the control value of each of the controllers of the air conditioner from the operation time information related to the air conditioner; b-2) detecting, by the server, a plurality of data of a first candidate data that are equal to the temperature and humidity measurement values of the outdoor air or have a minimum difference between the first candidate data and the temperature and humidity measurement values of the outdoor air in the database; b-3) detecting, by the server, in the first candidate data a plurality of data of a second candidate data that are equal to the control value of each of the controllers of the air conditioner or have a minimum difference between the second candidate data and the control value of each of the controllers of the air conditioner; and b-4) determining, by the server, an average value of the detected plurality of data of the second candidate data corresponding to a control value of each of the controllers of the air conditioner reducing an initial operation time of each of the controllers of the air conditioner.

The method for controlling the air conditioner may further include: after step b-4), storing, by the server, the determined average value in each of the controllers of the air conditioner and providing the stored average value as the control value reducing the initial operation time of each of the controllers in the manual mode of the air conditioning controller.

Step c) may include: switching, by the server, the manual mode to the automatic mode when a predetermined percentage of a stabilization time which is required for temperature and humidity of each of the zones of the spray booth to reach temperature and humidity stabilization condition values required for a painting process of each of the zones of the spray booth and is detected in the database using the operation time information is passed after the mode of the air conditioning controller is changed to the manual mode.

The method may further include: e) after step d), determining, by the server, the control value of each of the controllers of the air conditioner and the stabilization time to store the determined values in the temporary table when temperature and humidity measurement values of indoor air which is air inside each of the zones of the spray booth to which the air conditioner supplies heated air for a painting process of each of the zones of the spray booth reach the stabilization condition values.

The method may further include: after step e), confirming, by the server, whether data equal to the operation time information related to the air conditioner applied to determination of the stabilization time exist in the database; storing, by the server, the operation time information stored in the temporary table as new data in a learning table of the database when the data equal to the operation time information related to the air conditioner do not exist in the database; and updating, by the server, the operation time information stored in the temporary table as latest data in the database when the data equal to the operation time information related to the air conditioner exist in the database.

The method may further include: before step a), monitoring, by the server, whether a production line of a vehicle is operated and current temperature and humidity measurement values of the outdoor air; determining, by the server, a time when the vehicle arrives at the entrance of the spray booth when the production line is operated; determining, by the server, an operation prediction time of the air conditioner by determining the stabilization time which is detected from the database based on the current temperature and humidity measurement values of the outdoor air backward from the arrival time of the vehicle; and applying, by the server, an operation command to the air conditioning controller of each of the zones to start operation of the air conditioner when a current time reaches the operation prediction time.

The system and the method for controlling the air conditioner according to the exemplary embodiment of the present invention may shorten a time for adjusting an initial operation condition of the air conditioner by learning initial operation information history of the air conditioner mounted in each zone of the painting process line to cumulatively store the learned value in the database and operating the air conditioner based on the learned value or using initial operation information equal to the learned value.

The exemplary embodiment of the present invention may shorten the initial operation time of the air conditioner to reduce energy loss by shortening the initial operation time of the air conditioner to reduce the time for stabilizing the temperature and the humidity of the spray booth.

Furthermore, the exemplary embodiment of the present invention may provide the initial operation time and a control value for the air conditioner corresponding to a current state of the air conditioning equipment by updating the initial operation time of the air conditioner in the database when the time for stabilizing the temperature and the humidity of the spray booth is learned. The current state of the air conditioning equipment may include a state due to repair, modification, and aging of the equipment.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
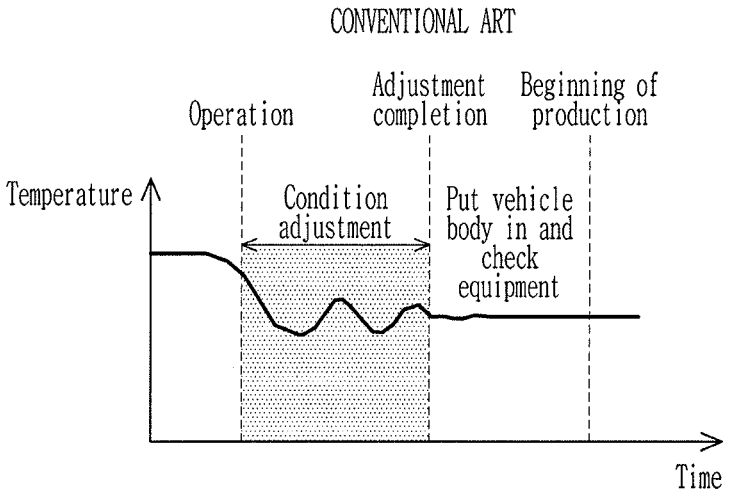
FIG. 1A and FIG. 1B are graphs showing an energy loss problem caused by a conventional air conditioner operation control.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present application will be described more fully hereinafter with reference to the accompanying drawings, in which exemplary embodiments of the present invention are shown. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising", will be understood to imply the inclusion of stated elements but not the exclusion of any other elements. Furthermore, the terms "-er", "-or" and "module" described in the specification mean units for processing at least one function and operation and may be implemented by hardware components or software components and combinations thereof.

Throughout the specification, terms such as "first", "second", etc. may be used to describe various elements, but the elements may not be limited by the terms. The terms are used only to distinguish one element from another. For example, a first element may be referred as a second element while not going beyond the scope of the rights of the present invention, and in a similar manner, the second element may be referred to as the first element.

A system and a method for controlling an air conditioner according to an exemplary embodiment of the present invention will now be described in detail with reference to the drawings.

Figure 2:
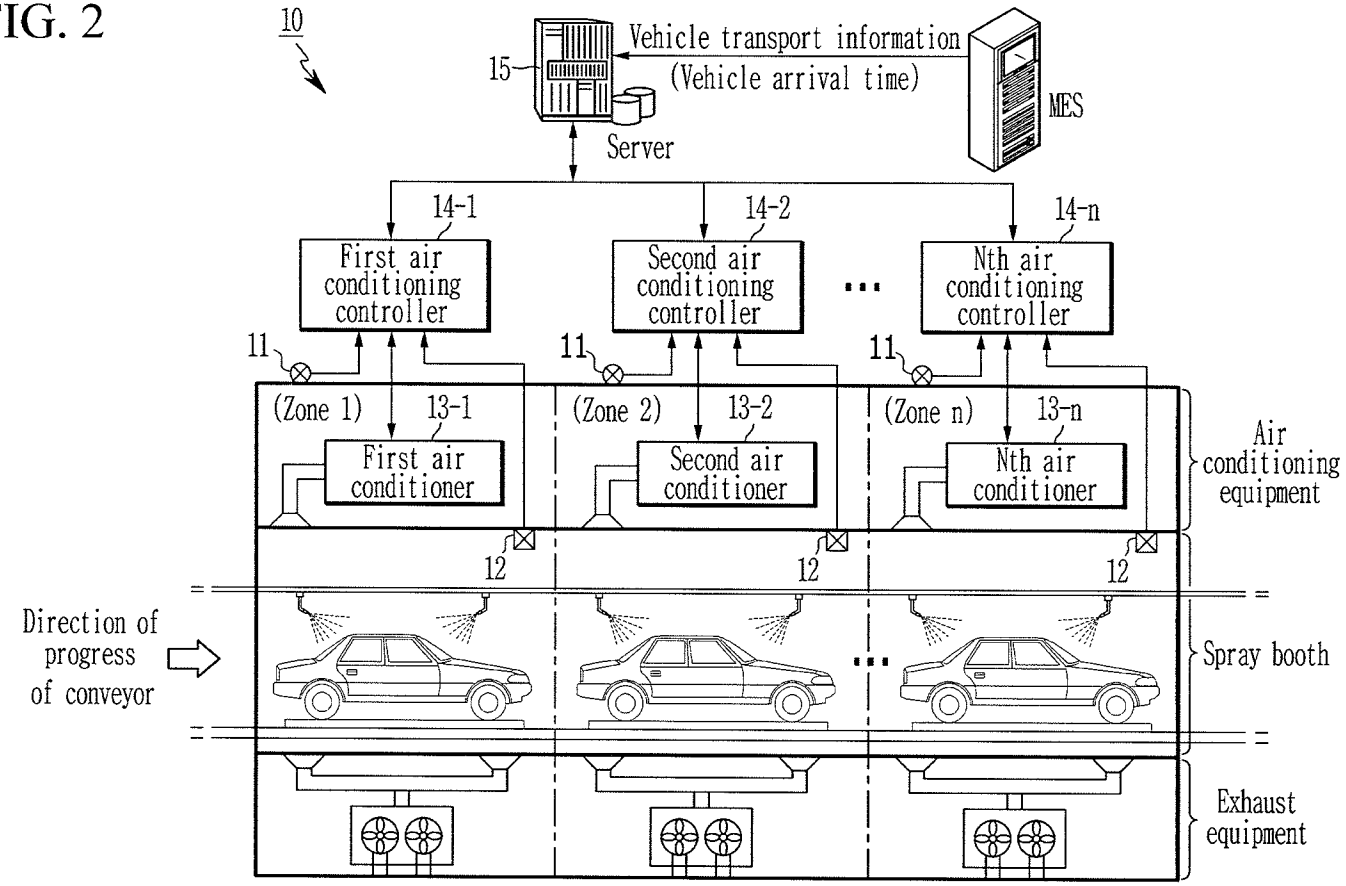
FIG. 2 shows a system for controlling an air conditioner disposed in a painting process line for a vehicle according to an exemplary embodiment of the present invention.

FIG. 2 shows the system for controlling the air conditioner disposed in a painting process line for a vehicle according to an exemplary embodiment of the present invention.

Figure 3:
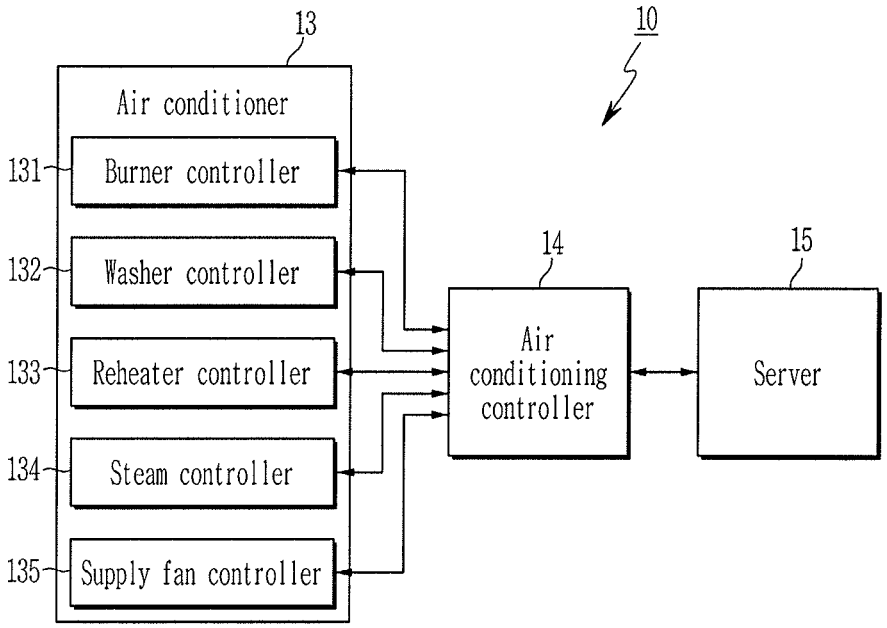
FIG. 3 is a block diagram schematically showing the system for controlling the air conditioner according to an exemplary embodiment of the present invention.

FIG. 3 is a block diagram schematically showing the system for controlling the air conditioner according to an exemplary embodiment of the present invention.

Referring to FIG. 2 and FIG. 3, the painting process line may include an air conditioning equipment, a spray booth, and an exhaust equipment, which include a plurality of zones along a direction of progress of a conveyor.

The air conditioning equipment may include a plurality of air conditioners 13-1, 13-2, . . . , **13-*n*** disposed in each of the zones and may supply heated air to an indoor space of the spray booth partitioned by each of the zones.

The spray booth may include a paint supply device so that it performs a painting work to spray paint on the vehicle or the vehicle body transported through the conveyor.

The exhaust equipment may include a duct and a fan so that it exhausts indoor air polluted by the painting work to the outside.

The system 10 for controlling the air conditioner may include an outdoor air measuring device (or an outdoor air meter) 11, an indoor air measuring device (or an indoor air meter) 12, an air conditioner 13, an air conditioning controller 14, and a server 15 for controlling an operation state of the air conditioner 13 disposed in the painting process line. The outdoor air measuring device 11, the indoor air measuring device 12, the air conditioner 13, and the air conditioning controller 14 may be disposed for each of the zones.

The air conditioner control system 10 may shorten a stabilization time at which the spray booth reaches a constant temperature and humidity for a painting process of the vehicle using an initial operation control for the air conditioner 13.

Also, the system 10 may automatically operate the air conditioner by predicting an initial operation time of the air conditioner based on the shortened stabilization time.

The outdoor air measuring device 11 may be disposed outside the air conditioning equipment so that it measures temperature and humidity of outdoor air flowing into the air conditioner 13.

The outdoor air measuring device 11 may transmit the temperature and the humidity of the outdoor air measured in real time to the air conditioning controller 14 via a communication line.

The indoor air measuring device 12 may measure temperature and humidity inside the spray booth in real time and may send the measured temperature and humidity to the air conditioning controller 14 through a communication line.

The outdoor air measuring device 11 or the indoor measuring device 12 may include a temperature sensor and a humidity sensor or an integrated sensor which combines a temperature sensor and a humidity sensor and may be mounted in each of the zones.

The air conditioner 13 may be disposed in each of the zones and may supply air heated according to temperature and humidity conditions required for the painting process of the spray booth.

One air conditioner 13 may be disposed for each of the zones of the spray booth in FIG. 2, but an exemplary embodiment of the present invention is not limited thereto. A plurality of air conditioners may be disposed for each of the zones according to size or capacity of the spray booth. An air speed and an operation condition of the air conditioner may be set differently depending on the size or the capacity of the spray booth.

The air conditioner 13 may include controllers (or control modules) for controlling a burner, a washer, a reheater, a steamer, and a supply fan to supply heated air into the spray booth.

In other words, as shown in FIG. 3, the air conditioner 13 may include a burner controller 131, a washer controller 132, a reheater controller 133, a steam controller (or a steamer controller) 134, and a supply fan controller 135. Each of the controllers 131-135 may be operated according to a predetermined value using a proportional—integral—derivative (PID) controller, and operation information related to each of the controllers may be transmitted to the air conditioning controller 14 through a communication line.

Figure 1B:
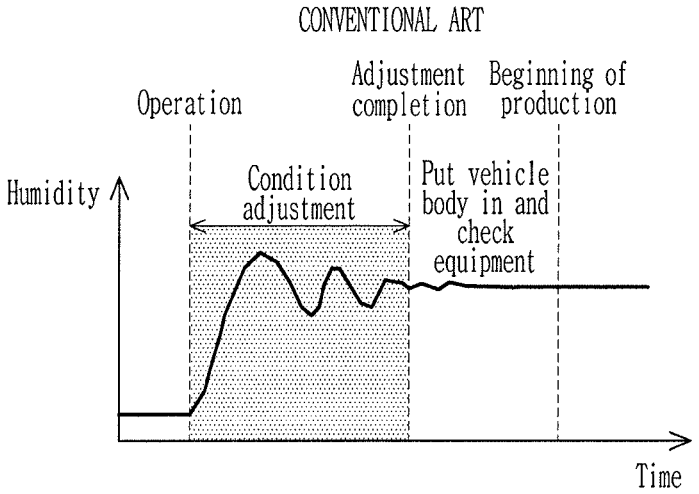

Each of the controllers 131-135 may be operated according to the temperature and the humidity of the outdoor air and the temperature and humidity stabilization condition values required for the painting process of each of the zones of the spray booth so that each of the controllers generates a manipulated variable (MV) which is a control value for initial operation and is included in an initial operation condition of the air conditioner and the controller 132 adjusts an opening rate of a washer pump of the air conditioner which is included in an initial operation condition of the air conditioner. Since various control modules are operated simultaneously when an air conditioner is operated in a conventional art, a time to reach the temperature and humidity stabilization conditions, which is a time for adjusting an initial operation condition of the air conditioner, takes excessively long, as shown in FIG. 1A and FIG. 1B.

In a severe condition where temperature of outdoor air of the air conditioner is low or humidity of the outdoor air is high, the time for adjusting the initial operation condition of the air conditioner is increased and an initial operation time of the air conditioner is increased.

The air conditioning controller 14 may be mounted for each zone and may control an operation state of the air conditioner 13 in line with the server 15.

The air conditioning controller 14 may receive temperature and humidity of the outdoor air measured at the outdoor air measuring device 11 and may transmit temperature and humidity of the outdoor air measured at the initial operation time of the air conditioner 13 to the server 15.

The air conditioning controller 14 may check whether temperature and humidity inside the spray booth received from the indoor measuring device 12 reaches the temperature and humidity stabilization conditions for the painting work. The air conditioning controller 14 may measure a time taken to reach the temperature and humidity stabilization conditions from the initial operation time to transmit the measured time to the server 15.

The temperature stabilization condition may have a predetermined allowable temperature or a permissible width $\pm\alpha°$ C. based on the stabilization temperature and humidity stabilization condition may have a predetermined allowable ratio (e.g., a predetermined allowable humidity) or a permissible width $\pm\beta\%$ based on the stabilization humidity. For example, the permissible width of the stabilization temperature may be ±1° C. and the permissible width of the stabilization humidity may be ±1° C. However, the present invention is not limited thereto, and the permissible width may vary depending on the size or the capacity of the spray booth.

The server 15, which is a central processing system for operating the painting process line, may learn operation information history of the air conditioner 13 collected through the air conditioning controller 14 disposed in each zone to accumulate the learned data in a database 154.

The server 15 may extract the control value for each of the controllers according to an initial operation condition of the air conditioner 13 from the learned data in the database when the air conditioner is operated, and may control each of the controllers of the air conditioner 13 for a predetermined time period based on the extracted data. Thus, the stabilization time at which the spray booth reaches the temperature and humidity stabilization conditions may be shortened and an unnecessary operation time of the air conditioner may be reduced.

Figure 4:
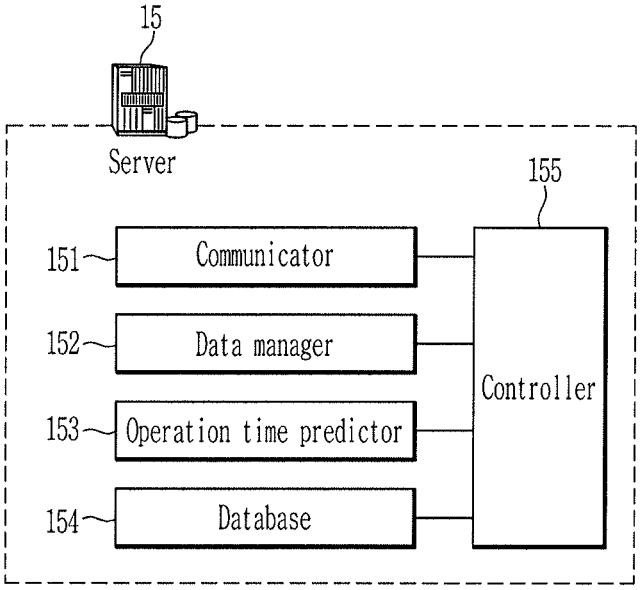
FIG. 4 is a block diagram schematically showing configuration of a server according to an exemplary embodiment of the present invention.

FIG. 4 is a block diagram schematically showing configuration of the server according to an exemplary embodiment of the present invention.

Referring to FIG. 4, the server 15 may include a communicator 151, a data manager 152, an operation time predictor 153, the database (DB) 154, and a controller 155.

The communicator 151 may include a wired and wireless interface for connection with an outdoor device and may be connected to the air conditioning controller 14 of each zone of the painting process line to collect operation information related to the air conditioner 13 in real time.

Also, the communicator 151 may be connected to a manufacturing execution system (MES) through a network in a factory with the painting process line to receive transport information related to the vehicle due to operation of the production line of the factory.

The data manager 152 may continuously receive the temperature and humidity of the outdoor air measured by the outdoor air measuring device 11 through each of the air conditioning controllers **14-1-14-*n* for each zone to store the received values in the database 154**.

The data manager 152 may continuously receive the temperature and the humidity inside the spray booth measured by the indoor measuring device 12 through each of the air conditioning controllers **14-1-14-*n* for each zone to store the received values in the database 154**.

The data manager 152 may collect at least one control value among a set point (SP), a process value (PV), the manipulated variable (MV), and the opening rate of the washer pump of each of the controllers of the air conditioner through each of the air conditioning controllers **14-1-14-*n* for each zone to store the collected value in the database 154**.

In other words, the data manager 152 may learn the control value for stabilizing the temperature and humidity inside the spray booth based on the operation information related to the air conditioner collected from each of the air conditioning controllers **14-1-14-*n* at an initial operation of the air conditioner to store the learned value in the database 154. To the present end, the database 154** may include a learning table or a memory for learning control values for each controller stored according to the temperature and the humidity of the outdoor air and the indoor air.

The operation information related to the air conditioner may include an operation state (e.g., an on state or an off state) of the air conditioner for each zone, temperature and humidity values of the outdoor air of the air conditioner collected at an initial operation of the air conditioner, temperature and humidity values of the indoor air, the temperature and humidity stabilization condition values, and the stabilization time required for the temperature and humidity of each of the zones of the spray booth to reach the temperature and humidity stabilization condition values. The stabilization time may mean a time at which the temperature and humidity inside the spray booth reaches the temperature and humidity stabilization conditions after the air conditioner is operated at the operation time in a response to the control value for each air conditioner.

The data manager 152 may update the learning table of the database 154 by matching the control value of each of the controllers 131-135 of the air conditioner 13 with the stabilization time. The each of the controllers 131-135 may generate the control value that generates the stabilization condition values based on the temperature and humidity values of the outdoor air and the indoor air collected at every initial operation time of the air conditioner 13 for each zone.

The data manager 152 may update currently learned information as latest information when information equal to the currently learned information exists in the learning table at a time of updating the learning table.

The data manager 152 may add or store currently learned information as new learning data in the learning table of the database 154 when information equal to the currently learned information does not exist in the learning table.

The operation time predictor 153 may derive the stabilization time for each of the zones of the spray booth based on the temperature and humidity values of the outdoor air referring to the table of the database.

Furthermore, the operation time predictor 153 may continuously determine an operation prediction time of the air conditioner 13 by determining the stabilization time backward from a time when the vehicle arrives at the painting process line due to operation of the production line of the factory.

The database 154 may store various programs and data for control of each air conditioner 13 disposed in the painting process line and may store data generated according to operation of the air conditioner 13.

The database 154 may cumulatively store the control value of each of the controllers 131-135 corresponding to the stabilization time according to operation information history of each air conditioner 13 in the learning table of the database and may provide the control value and the stabilization time to derive an operation prediction time of the air conditioner and a control value for the air conditioner.

Furthermore, the database 154 may store the operation history, operation schedule, operation state information, and processing result information related to the air conditioner 13 for each zone.

The controller 155 may include at least one processor that stores a program and data controlling components of the server 15 to control an initial operation of the air conditioner and utilizes the program and the data.

The controller 155 may interlock with the air conditioning controller 14 disposed in each zone of the painting process line through the factory network to control an operation time of the air conditioner when the production line is operated and the initial operation condition of the air conditioner.

The controller 155 may check operation of the production line through the factory network to control automatic operation of the air conditioner for 24 hours without operator intervention.

The controller 155 may receive the vehicle transport information due to operation of the production line of the factory from the MES to determine a time when the vehicle at the very front of the conveyor arrives at an entrance of the spray booth.

The controller 155 may determine the operation prediction time of the air conditioner 13 by determining the stabilization time backward from a time when the vehicle arrives at the spray booth.

The controller 155 may determine whether a deviation value RESULT_TIME comparing the operation prediction time of the air conditioner which is continuously updated by the operation time predictor 153 with a current time is within an allowable time (e.g., 10 minutes). When the current time reaches the operation prediction time, the controller 155 may apply an operation command to the air conditioning controller 14 of each zone to start operation of the air conditioner 13.

When operation of the air conditioner 13 is started, the controller 155 may search the operation information related to the air conditioner equal to current temperature and humidity of the outdoor air in the learning table of the database 154 to detect the control value of each of the controllers 131-135 matched with the stabilization time for an initial operation control for the air conditioner. The controller 155 may change a mode of the air conditioning controller 14 to a manual mode to apply the detected control value to the initial operation condition or an initial operation value of each controller of the air conditioner 13 for the predetermined time period. The controller 155 may switch a mode of the air conditioning controller 14 to an automatic mode after the detected control value is applied to the initial operation condition of each controller. Thus, the mode of the air conditioning controller is not controlled to the automatic mode set as default of the air conditioner 13 and the air conditioner may be forcibly controlled for a predetermined time period by the control value detected in the learning data.

For example, the controller 155 may forcibly apply the learned control value to the air conditioner 13 for a predetermined time period equivalent to 80% of the stabilization time to stabilize temperature and humidity inside the spray booth as rapidly as possible. Accordingly, a time for stabilizing the temperature and the humidity of the spray booth may be shortened during the initial operation of the air conditioner.

Figure 5A:
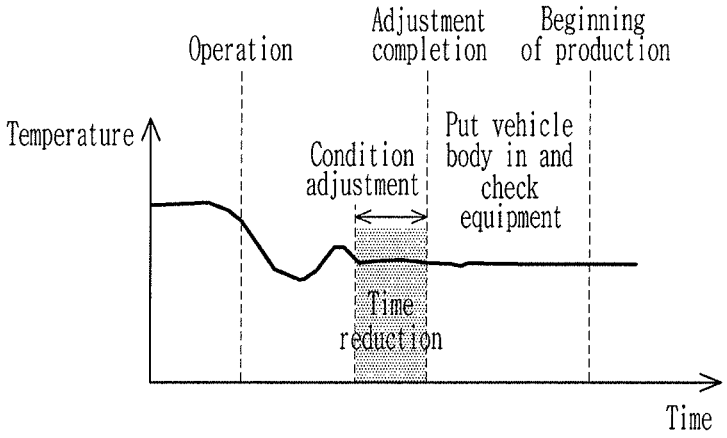
FIG. 5A and FIG. 5B are graphs showing a result of reduced temperature and humidity control times when the air conditioner is operated according to an exemplary embodiment of the present invention.
Figure 5B:
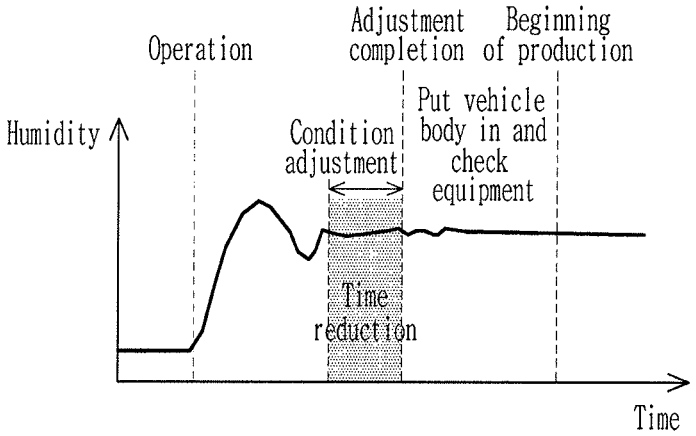

FIG. 5A and FIG. 5B are graphs showing a result of reduced temperature and humidity control times when the air conditioner is operated according to an exemplary embodiment of the present invention.

Referring to FIG. 5A and FIG. 5B, the controller 155 may automatically adjust an initial operation condition of the air conditioner using the learned control value equal to a current operation condition of the air conditioner to shorten an adjustment time until the temperature and humidity of the spray booth reaches the stabilized temperature and humidity values.

The controller 155 may monitor whether temperature and humidity inside the spray booth reaches the stabilization condition values and may learn the stabilization time and the control value of each of the controllers 131-135 corresponding to the stabilization time to update the learned values in the database 154 using the data manager 152 when the temperature and humidity inside the spray booth reaches the stabilization condition values.

The controller 155 may update the learned information as latest information in the database 154 when the same information as the learned information exists in the database and may add or store the learned information as new data in the database 154 when the same information as the learned information does not exist in the database.

The controller 155 may stop operation of the air conditioner 13 by applying a stop command to the air conditioning controller 14 when a production end signal according to stop of the production line of the factory is received from the MES.

At the present time, the controller 155 may collect information such as an operation date, an operation day, an operation time, and processing result of the air conditioner 13 from the air conditioning controller 14 to store the collected information in the database 154.

The controller 155 may provide through a user interface (UI) various information such as a main screen for automatic operation setting of the air conditioner for each zone, a voice alarm system setting screen, an environment setting and production plan registration screen, or an air conditioner operation history inquiry screen based on information or data stored in the database 154. For example, the main screen may display an operation time of the air conditioner in advance based on the stabilization time stored in the database and a process operation condition before and after stop of the air conditioner due to a holiday of the factory, may generate an alarm in a message window when abnormality of the air conditioner occurs, and may include a switch key for easy switching between an automatic operation mode and a manual operation mode.

The controller 155 may monitor an operation state of the air conditioner 13 to set an announcement according to detection of an operation signal or an abnormal signal of the air conditioner and may switch the set announcement to a voice. The voice alarm system setting screen may broadcast the voice. The voice alarm system may be a foolproof system that allows the operator to recognize operation of the air conditioner.

The environment setting and production plan registration screen may be accessible only to an authorized person registered in advance and may provide a menu for a characteristic input for the factory or for registration of a strike and an overtime schedule generated per year or irregularly to reflect various environmental conditions.

The operation history inquiry screen of the air conditioner may provide an operation history inquiry function of the air conditioner for each zone and an operation value inquiry function of the air conditioning controller.

An air conditioner control method for shortening the initial operation time of the air conditioner according to an exemplary embodiment of the present invention based on the configuration of the air conditioner control system 10 will be described with reference to FIG. 6, FIG. 7, and FIG. 8. Because elements of the server 15 described above may be further subdivided into functions or integrated into one system, the server 15 may be referred to as the subject or a main agent of each step of FIGS. 6, 7 and 8.

Figure 6:
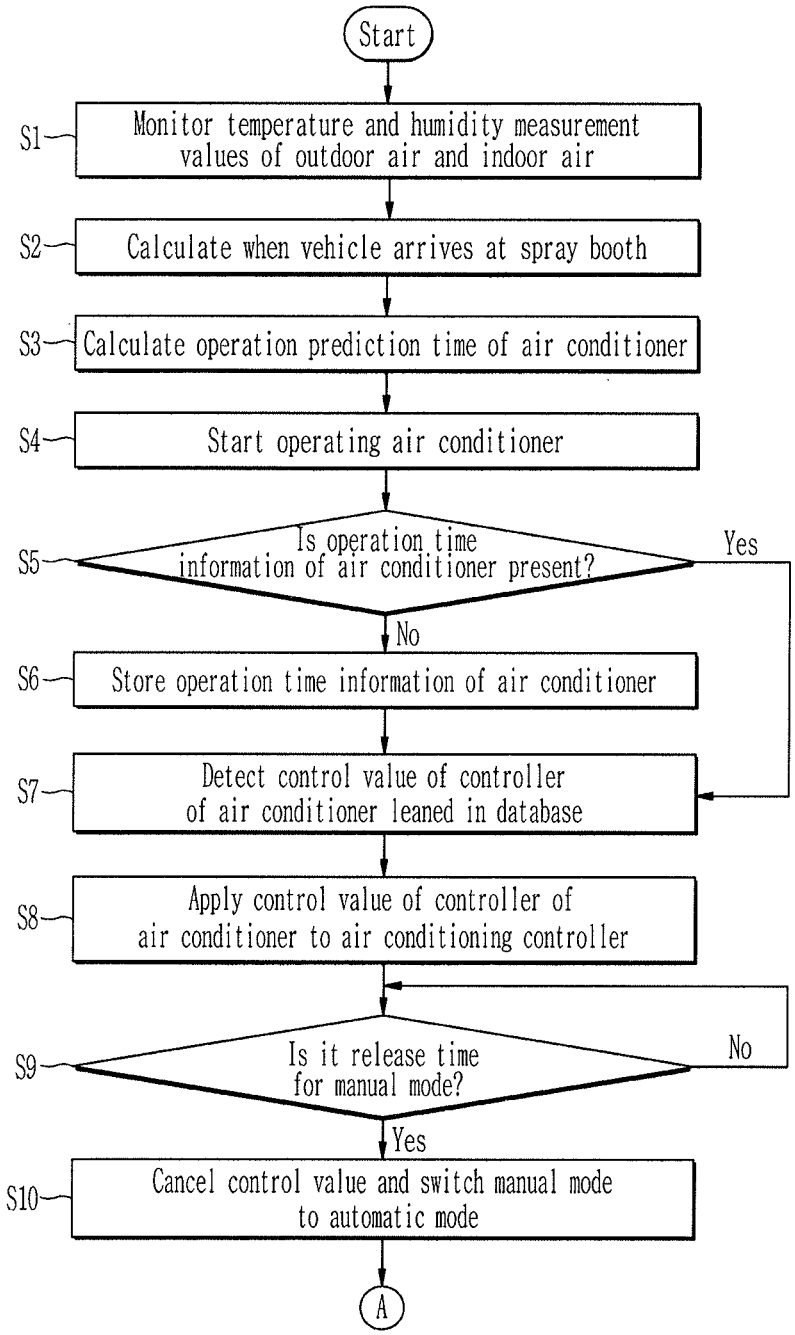
FIG. 6 and FIG. 7 are flowcharts illustrating an air conditioner control method for reducing an initial operating time of the air conditioner according to an exemplary embodiment of the present invention.
Figure 7:
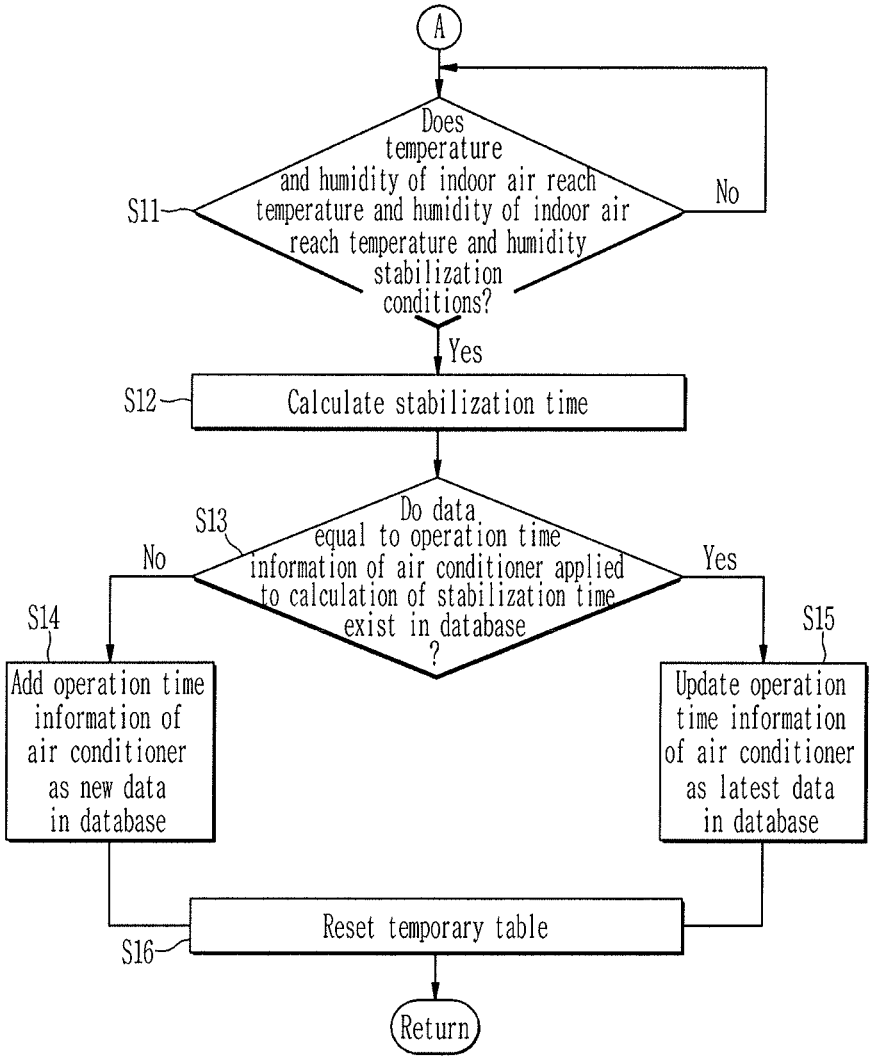

FIG. 6 and FIG. 7 are flowcharts illustrating the air conditioner control method for reducing the initial operating time of the air conditioner according to an exemplary embodiment of the present invention.

Referring to FIG. 6 and FIG. 7, it is assumed that the air conditioner control method starts from an un-activated state of the air conditioner disposed in the spray booth.

The server 15 may monitor whether the production line is in operation and current temperature and humidity measurement values of the outdoor air and the indoor air of the air conditioning controller 14 for automatic operation control for 24 hours for the air conditioner 13 (step S1). The temperature and humidity measurement values of the outdoor air and the indoor air may be continuously received and may be updated in a temporary storage of the database 154 regardless of whether the air conditioner is operated.

The server 15 may determine the time when the vehicle arrives at the entrance of the spray booth when the production line is operated (step S2)

The server 15 may compute the operation prediction time of the air conditioner 13 by determining the stabilization time detected from the database 154 based on current temperature and humidity of the outdoor air backward from the arrival time of the vehicle (step S3).

When a current time reaches the operation prediction time, the server 15 may apply the operation command to the air conditioning controller 14 of each zone to start operation of the air conditioner 13 (step S4).

The server 15 may interlock with the air conditioning controller 14 for each zone to control an initial operation condition of the air conditioner based on logic for shortening an initial operation time of the air conditioner.

The server 15 may determine whether operation time information related to the air conditioner 13 is present in a temporary table of the database 154 when the air conditioner is operated (step S5). When the operation time information related to the air conditioner is not present in the temporary table (No in the step S5), the server 15 may collect the operation time information related to the air conditioner to store the collected information in the temporary table (step S6). The operation time information related to the air conditioner may include at least one among an operation time of the air conditioner, the temperature and humidity measurement values of the outdoor air, the temperature and humidity measurement values of the indoor air, temperature of the air conditioner, the set point (SP), the process value (PV), and the manipulated variable (MV) of each of the controllers of the air conditioner, and the opening rate of the washer pump. The set point (SP) may be a target value and the process value (PV) may be a measurement value.

When the operation time information related to the air conditioner exists in the temporary table (Yes in the step S5), the server 15 may detect the control value of each of the controllers of the air conditioner that corresponds to temperature and humidity of the outdoor air and is equal to the operation time information from the database 154 (step S7). The control value may include the manipulated variable (MV) and the opening rate of the washer pump.

The server 15 may change the mode of the air conditioning controller 14 to the manual mode and may apply the control value of each of the controllers of the air conditioner read from the database 154 to the air conditioning controller for a predetermined time period (step S8). The server 15 may check whether the control value read from the database 154 is applied to the air conditioning controller 14 of each zone of the spray booth. When the control value read from the database 154 is not applied to the air conditioning controller 14, the server 15 may change the mode of the air conditioning controller 14 to the manual mode and may forcibly apply the control value of each of the controllers of the air conditioner to the air conditioning controller for the predetermined time period.

When a release time for the manual mode is reached after the predetermined time period (Yes in step S9), the server 15 may cancel the control value applied to the air conditioning controller and may switch or change the manual mode to the automatic mode (step S10). For example, the server 15 may switch the manual mode to the automatic mode when 80% of the stabilization time detected in the database 154 using the operation time information is passed after the mode of the air conditioning controller is changed to the manual mode.

The server 15 may confirm or check whether the temperature and humidity measurement values of the indoor air of each zone of the spray booth reach the temperature and humidity stabilization conditions (step S11). When the temperature and humidity measurement values of the indoor air do not reach the stabilization conditions (No in the step S11), a control for the air conditioner may be continued.

When the temperature and humidity measurement values of the indoor air reach the stabilization conditions (Yes in the step S11), the server 15 may determine the control value of each of the controllers of the air conditioner and the stabilization time and may store the determined values in the temporary table (step S12).

The server 15 may confirm or check whether data equal to the operation time information related to the air conditioner applied to determination of the stabilization time exist in the database 154 (step S13). When the data equal to the operation time information related to the air conditioner do not exist in the database 154 (No in the step S13), the server 15 may add or store the operation time information stored in the temporary table as the new data in the learning table of the database 154 (step S14). The server 15 may update the learning table of the database 154 by matching the control value of each of the controllers 131-135 of the air conditioner 13 with the stabilization time. The each of the controllers 131-135 may generate the control value that generates the stabilization condition values based on the temperature and humidity values of the outdoor air and the temperature and humidity values of the indoor air stored in the temporary table.

When the data equal to the operation time information related to the air conditioner exist in the database 154 (Yes in the step S13), the server 15 may update the operation time information stored in the temporary table as latest data in the database (step S15).

The server 15 may update the database 154 with the new data or the latest data and then may reset data stored in the temporary table (step S16). The server 15 may repeat the above process every time the air conditioner is operated.

A method of detecting the control value of each of the controllers of the air conditioner corresponding to the step S7 of FIG. 6 will be described with reference to FIG. 8.

Figure 8:
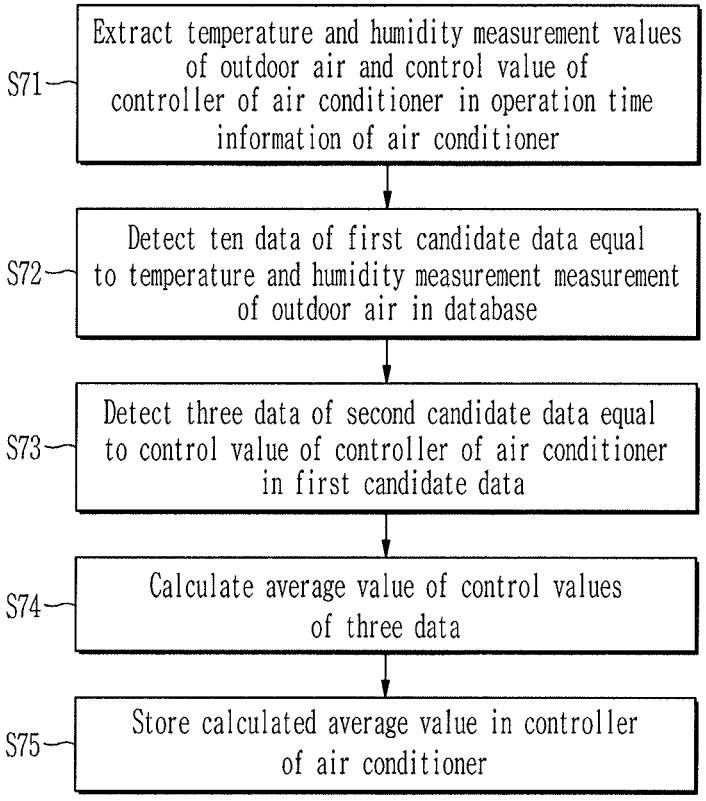
FIG. 8 shows a method of detecting a control value for shortening the initial operation time of the air conditioner according to an exemplary embodiment of the present invention.

FIG. 8 shows the method of detecting the control value for shortening the initial operation time of the air conditioner according to an exemplary embodiment of the present invention.

Referring to FIG. 8, the server 15 may extract the temperature and humidity measurement values of the outdoor air and the control value of each of the controllers of the air conditioner from the operation time information related to the air conditioner collected at the air conditioning controller 14 (step S71).

The server 15 may detect ten data of a first candidate data that are equal to the temperature and humidity measurement values of the outdoor air or have a minimum difference between the first candidate data and the temperature and humidity measurement values of the outdoor air in the database 154 (step S72). The number of the first candidate data is assumed to be 10, but the number thereof is not limited to the present and may be changed.

The server 15 may detect in the first candidate data three data of a second candidate data that are equal to the control value of each of the controllers of the air conditioner or have a minimum difference between the second candidate data and the control value of each of the controllers of the air conditioner (step S73). The number of the second candidate data is assumed to be three, but the number of the candidate data is not limited thereto and may be changed.

The server 15 may finally determine an average value of the detected three control values (step S74).

The server 15 may store the determined average value in each of the controllers of the air conditioner or a feedback address of each of the controllers (step S75). The stored control value may be applied as a control value for reducing the initial operation time of each of the controllers in the manual mode of the air conditioning controller.

The server 15 may perform the method or a process of FIG. 8 to set the control value for the initial operation time reduction of each of the controllers of the air conditioner.

The exemplary embodiment of the present invention may shorten a time for adjusting an initial operation condition of the air conditioner by learning initial, operation information history of the air conditioner disposed in each zone of the painting process line to cumulatively store the learned value in the database and operating the air conditioner based on the learned value or using initial operation information equal to the learned value.

The exemplary embodiment of the present invention may shorten the initial operation time of the air conditioner to reduce energy loss by shortening the initial operation time of the air conditioner to reduce the time for stabilizing the temperature and the humidity of the spray booth.

Furthermore, the exemplary embodiment of the present invention may provide the initial operation time and a control value for the air conditioner corresponding to a current state of the air conditioning equipment by updating the initial operation time of the air conditioner in the database when the time for stabilizing the temperature and the humidity of the spray booth is learned. The current state of the air conditioning equipment may include a state due to repair, modification, and aging of the equipment.

The exemplary embodiment of the present invention is not implemented only by the aforementioned apparatus and/or method, and may be implemented by a program for operating a function corresponding to the configuration of the exemplary embodiment of the present invention, a recording medium in which the program is recorded, and the like, and the implementation may be easily realized from the description of the aforementioned exemplary embodiment of the present invention by those skilled in the art.

For convenience in explanation and accurate definition in the appended claims, the terms "upper", "lower", "inner", "outer", "up", "down", "upwards", "downwards", "front", "rear", "back", "inside", "outside", "inwardly", "outwardly", "indoor", "outdoor", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A system for controlling a plurality of air conditioners of a painting process line including an air conditioning equipment having the plurality of air conditioners, spray booth, and exhaust equipment that are divided into a plurality of zones, the system comprising:

an outdoor air measuring device configured to measure temperature and humidity of outdoor air flowing into the plurality of air conditioners;

an indoor air measuring device configured to measure temperature and humidity inside each of the zones of the spray booth;

the plurality of air conditioners including controllers, wherein each of the plurality of air conditioners is disposed in each of the zones of the air conditioning equipment and configured to supply heated air according to temperature and humidity stabilization conditions required for a painting process of each of the zones of the spray booth;

a plurality of air conditioning controllers connected to the plurality of air conditioners and configured to transmit operation information related to the plurality of air conditioners including the temperatures and humidities measured by the outdoor air measuring device and the indoor air measuring device and to operate the plurality of air conditioners when a control value is received; and a server connected to the plurality of air conditioning controllers and configured to learn operation information history of the plurality of air conditioners collected through the air conditioning controllers to accumulate learned data in a database and to extract the control value for each of the controllers of the plurality of air conditioners according to an initial operation condition of the plurality of air conditioners from the learned data in the database to control each of the controllers of the plurality of air conditioners for a predetermined time period based on the extracted control value, wherein the server includes:

a communicator connected to the plurality of air conditioning controllers to collect the operation information related to the plurality of air conditioners;

a data manager configured to learn the control value for stabilizing the temperature and humidity inside the spray booth based on the operation information related to the plurality of air conditioners collected from the plurality of air conditioning controllers disposed in each of the zones at an initial operation of the plurality of air conditioners to update the learned control value in the database;

an operation time predictor configured to derive a stabilization time required for temperature and humidity of each of the zones of the spray booth to reach values of the temperature and humidity stabilization conditions based on the temperature and the humidity of the outdoor air referring to the database and to determine an operation prediction time of the plurality of air conditioners by determining the stabilization time backward from a time when a vehicle arrives at each of the zones of the spray booth;

the database configured to store the control value of each of the controllers of the plurality of air conditioners corresponding to the stabilization time according to the operation information history of the plurality of air conditioners in a learning table of the database; and a controller configured to interlock with the plurality of air conditioning controllers disposed in each of the zones of the painting process line to control an operation time of the plurality of air conditioners when a production line of the vehicle is operated and the initial operation condition of the plurality of air conditioners.

2. The system of claim 1, wherein the plurality of air conditioning controllers is configured to check when temperature and humidity inside each of the zones of the spray booth reaches the temperature and humidity stabilization conditions and to measure a time taken to reach the temperature and humidity stabilization conditions from an initial operation time of the plurality of air conditioners to transmit the measured time to the server.

3. The system of claim 2, wherein the temperature stabilization condition includes a predetermined allowable temperature based on stabilization temperature and humidity stabilization condition includes a predetermined allowable humidity based on stabilization humidity.

4. The system of claim 1, wherein the controllers of the plurality of air conditioners are a burner controller, a washer controller, a reheater controller, a steam controller, and a supply fan controller, and wherein the data manager is configured to update the learning table of the database by matching the control value of each of control values of the burner controller, the washer controller, the reheater controller, the steam controller, and the supply fan controller of the plurality of air conditioners that generates stabilization condition values with the stabilization time based on the temperature and the humidity of the outdoor air collected by the plurality of air conditioning controllers at every initial operation time of the plurality of air conditioners for each of the zones.

5. The system of claim 4, wherein the data manager is configured to update currently learned information corresponding to the control value matched with the stabilization time as latest information when information equal to the currently learned information exists in the learning table at a time of updating the learning table and to store currently learned information as new learning data in the learning table of the database when information equal to the currently learned information does not exist in the learning table.

6. The system of claim 1, wherein the controller of the server is configured to search the operation information related to the plurality of air conditioners equal to current temperature and humidity of the outdoor air in the learning table of the database to detect the control value of each of the controllers of the plurality of air conditioners matched with the stabilization time for an initial operation control for the plurality of air conditioners when the plurality of air conditioners are operated.

7. The system of claim 6, wherein the controller of the server is configured to detect a plurality of data of a first candidate data that are equal to the temperature and the humidity value of the outdoor air or have a minimum difference between the first candidate data and the temperature and the humidity of the outdoor air in the learning table of the database and to detect in the first candidate data a plurality of data of a second candidate data that are equal to the control value of each of the controllers of the plurality of air conditioners or have a minimum difference between the second candidate data and the control value of each of the controllers of the plurality of air conditioners to determine an average value of the detected plurality of data of the second candidate data corresponding to a control value of each of the controllers of the plurality of air conditioners reducing an initial operation time of each of the controllers of the plurality of air conditioners.

8. The system of claim 6, wherein the controller of the server is configured to change a mode of the plurality of air conditioning controllers to a manual mode to apply the detected control value to the initial operation condition of each of the controllers of the plurality of air conditioners for the predetermined time period and to switch the mode of the plurality of air conditioning controllers to an automatic mode after the detected control value is applied to the initial operation condition of each of the controllers of the plurality of air conditioners.

9. The system of claim 8, wherein the controller of the server is configured to apply the detected control value to the plurality of air conditioners for a predetermined time period equivalent to a predetermined percentage of the stabilization time after the mode of the plurality of air conditioning controllers are changed to the manual mode.

10. The system of claim 6, wherein the controller of the server is configured to monitor when temperature and humidity inside the spray booth reaches stabilization condition values and to learn the stabilization time and the control value of each of the controllers of the plurality of air conditioners corresponding to the stabilization time to update the learned stabilization time and control value in the learning table of the database using the data manager when the temperature and humidity inside the spray booth reaches the stabilization condition values.

11. A method of controlling a plurality of air conditioners by a server of a system for controlling the plurality of air conditioners which are disposed in each of zones of a painting process line including a spray booth, the method comprising:

a) storing, by the server, operation time information related to the plurality of air conditioners collected from an air conditioning controller that is configured to control the plurality of air conditioners and is disposed in each of the zones of the painting process line in a temporary table of a database when operation of the plurality of air conditioners is started;

b) detecting, by the server, a control value of each of controllers of the plurality of air conditioners that corresponds to temperature and humidity of outdoor air flowing into the plurality of air conditioners and is equal to the operation time information from the database in which operation information history of the plurality of air conditioners is stored;

c) changing, by the server, a mode of the plurality of air conditioning controllers to a manual mode and applying the control value of each of the controllers of the plurality of air conditioners to the plurality of air conditioning controllers for a predetermined time period; and d) canceling, by the server, the control value applied to the plurality of air conditioning controllers and switching the manual mode to an automatic mode of the plurality of air conditioning controllers when a release time for the manual mode is reached after the predetermined time period, wherein the control value includes a control value for initial operation of each of the controllers of the plurality of air conditioners and an opening rate of a washer pump of the plurality of air conditioners, and wherein step b) includes:

b-1) extracting, by the server, temperature and humidity measurement values of the outdoor air and the control value of each of the controllers of the plurality of air conditioners from the operation time information related to the plurality of air conditioners;

b-2) detecting, by the server, a plurality of data of a first candidate data that are equal to temperature and humidity measurement values of the outdoor air or have a minimum difference between the first candidate data and the temperature and humidity measurement values of the outdoor air in the database;

b-3) detecting, by the server, in the first candidate data a plurality of data of a second candidate data that are equal to the control value of each of the controllers of the plurality of air conditioners or have a minimum difference between the second candidate data and the control value of each of the controllers of the plurality of air conditioners; and b-4) determining, by the server, an average value of the detected plurality of data of the second candidate data corresponding to a control value of each of the controllers of the plurality of air conditioners reducing an initial operation time of each of the controllers of the plurality of air conditioners.

12. The method of claim 11, wherein the operation time information related to the plurality of air conditioners includes at least one among an operation time of the plurality of air conditioners, temperature and humidity measurement values of the outdoor air, temperature and humidity measurement values of indoor air which is air inside each of the zones of the spray booth to which the plurality of air conditioners supplies heated air for a painting process of each of the zones of the spray booth, temperature of the plurality of air conditioners, an opening rate of a washer pump of the plurality of air conditioners, a target value, a measurement value, and a control value for initial operation of each of the controllers of the plurality of air conditioners.

13. The method of claim 11, further including:

after step b-4), storing, by the server, the determined average value in each of the controllers of the plurality of air conditioners and providing the stored average value as a control value reducing the initial operation time of each of the controllers in the manual mode of the air conditioning controller.

14. The method of claim 13, wherein step c) includes:

switching, by the server, the manual mode to the automatic mode when a predetermined percentage of a stabilization time which is required for temperature and humidity of each of the zones of the spray booth to reach temperature and humidity stabilization condition values required for a painting process of each of the zones of the spray booth and is detected in the database using the operation time information is passed after the mode of the plurality of air conditioning controllers is changed to the manual mode.

15. The method of claim 14, further including:

e) after step d), determining, by the server, the control value of each of the controllers of the plurality of air conditioners and the stabilization time to store the determined values in the temporary table when temperature and humidity measurement values of indoor air which is air inside each of the zones of the spray booth to which the plurality of air conditioners supplies heated air for a painting process of each of the zones of the spray booth reach the temperature and humidity stabilization condition values.

16. The method of claim 15, further including:

after step e), confirming, by the server, when data equal to the operation time information related to the plurality of air conditioners applied to the determination of the stabilization time exist in the database;

storing, by the server, the operation time information stored in the temporary table as new data in a learning table of the database when the data equal to the operation time information related to the plurality of air conditioners do not exist in the database; and updating, by the server, the operation time information stored in the temporary table as latest data in the database when the data equal to the operation time information related to the plurality of air conditioners exist in the database.

17. The method of claim 15, further including:

before step a), monitoring, by the server, when a production line of a vehicle is operated and current temperature and humidity measurement values of the outdoor air;

determining, by the server, a time when the vehicle arrives at an entrance of the spray booth when the production line is operated;

determining, by the server, an operation prediction time of the plurality of air conditioners by determining the stabilization time which is detected from the database based on the current temperature and humidity measurement values of the outdoor air backward from an arrival time of the vehicle; and applying, by the server, an operation command to the plurality of air conditioning controllers of each of the zones to start operation of the plurality of air conditioners when a current time reaches the operation prediction time.

* * * * *